United States Patent [19]

Hodges

[11] 4,025,074

[45] May 24, 1977

[54] MINI-DOME BASKETBALL GAME

[76] Inventor: Leon R. Hodges, 1656 Ellis, Wichita, Kans. 67211

[22] Filed: Aug. 22, 1975

[21] Appl. No.: 606,852

[52] U.S. Cl. ..... 273/101; 273/105 R
[51] Int. Cl.[2] ..... A63F 7/00
[58] Field of Search ..... 273/85 E, 85 F, 101, 273/103, 105 R, 85 C

[56] References Cited

UNITED STATES PATENTS

| | | | |
|---|---|---|---|
| 1,354,749 | 10/1920 | Holwick | 273/101 |
| 1,982,491 | 11/1934 | Barnum | 273/85 E |
| 2,114,777 | 4/1938 | Englerth | 273/101 |
| 2,611,615 | 9/1952 | Watson et al. | 273/105 R |
| 2,720,397 | 10/1955 | Blanton | 273/101 |
| 3,074,720 | 1/1963 | Carver et al. | 273/101 |
| 3,108,808 | 10/1963 | Peterson | 273/101 |
| 3,622,160 | 11/1971 | Barfield | 273/101 |
| 3,899,173 | 8/1975 | Zaris | 273/101 |

FOREIGN PATENTS OR APPLICATIONS

| | | | |
|---|---|---|---|
| 505,477 | 12/1954 | Italy | 273/101 |
| 7,088 | 4/1896 | United Kingdom | 273/101 |

*Primary Examiner*—Richard C. Pinkham
*Assistant Examiner*—Harry G. Strappello
*Attorney, Agent, or Firm*—Phillip A. Rein

[57] ABSTRACT

This invention is a mini-dome basketball game including an enclosure structure resembling a basketball court having an actuator structure with a plurality of actuator flipper members operable to contact a ball member to propell the same upwardly and forwardly towards a basket member to simulate a basketball game. The playing area is enclosed by a clear plastic dome to maintain the ball member therewithin and includes a score device mounted on the enclosure means operable to keep score between the players similar to a regulation basketball game. The actuator flipper members includes one for each of the two players and a third free-throw zone to propell the ball member toward the basket member in free-throw situations.

4 Claims, 3 Drawing Figures

MINI-DOME BASKETBALL GAME

Numerous game structures are known in the prior art and some are drawn to basketball amusement devices having means thereon to propell a ball member towards a basket member to simulate an actual basketball game. However, most of the prior art devices are rather complex in nature having a plurality of actuator members to simulate competition between players of a basketball game but are not operable in a manner similar to the applicant's invention as noted herein.

In one preferred embodiment of this invention, a mini-dome basketball game is provided having a main enclosure means with a score means mounted thereon and enclosed in the enclosure means is an actuator means. The enclosure means includes a basic support means; a back stop means extended upwardly and vertically and secured to the basic support means; and a dome means connected to the back stop means and the basic support means to enclose a quarter of a sphere area. The basic support means includes a support floor assembly adapted to be extended generally horizontally. The back stop means includes a semi-circular support member having a lower portion connected to the support floor assembly. The dome means includes a transparent cover member being a quarter of a sphere which is operably connected to the support member and the support floor assembly to provide an enclosed area. The score means includes a housing assembly having a plurality of rotatable disc members therein and the same is connected to an upper portion of the support member of the back stop means. Each of the disc members has numerical indicia thereon and rotatable to present visible observation of the score between players in the subject basketball game. The actuator means includes actuator flipper members and game members. The actuator flipper members includes a pair of player flipper members and a free-throw flipper member which is anchored to a central portion of the basic support means and is pivotal thereabout. The game members includes a basket member which is attached to a central portion of the upright support member and a ball member. The ball member is of a size to be propelled by the player members and the free-throw flipper member upwardly to pass through the basket member thereby resembling an actual basketball game in operation. The actuator flipper members are pivotable about a central, common connector point in an arc about the support floor assembly and they are operable to be placed underneath the ball member and on downward depression and subsequent release, is operable to hit the ball member and propell the same towards the basket member to achieve a score by such operation.

One object of this invention is to provide a game structure to simulate an actual basketball game as observed through a clear plastic transparent cover member.

Another object of this invention is to provide a mini-dome basketball game having a basic support means resembling a basketball players court, a back stop means having a basket member thereon and resembling a basketball goal area; and an actuator means having a plurality of flipper members operable to propell a ball member towards a basket member which, in turn, is attached to the back stop means to thereby resemble the entire basketball game structure.

One other object of this invention is to provide a mini-dome basketball game having a simulated basketball goal area and floor area enclosed by a transparent quarter of a sphere cover to keep the ball member therewithin and, additionally, having a score means which is operable to keep the score between two players or opposing teams.

Another object of this invention is to provide a mini-dome basketball game which can be readily played by two players and having a movable flipper member operable to engage a ball member and propell the same towards a basket member to simulate one actually shooting the ball member which is propelled by impact of the flipper members against the ball member.

Still, one further object of this invention is to provide a mini-dome basketball game which is economical to manufacture; sturdy in construction; easy to operate; and provides a continuous means of entertainment by simulating an actual basketball game.

Various other objects, advantages, and features of the invention will become apparent to those skilled in the art from the following discussion, taken in conjunction with the accompanying drawings, in which.

Figure 1:
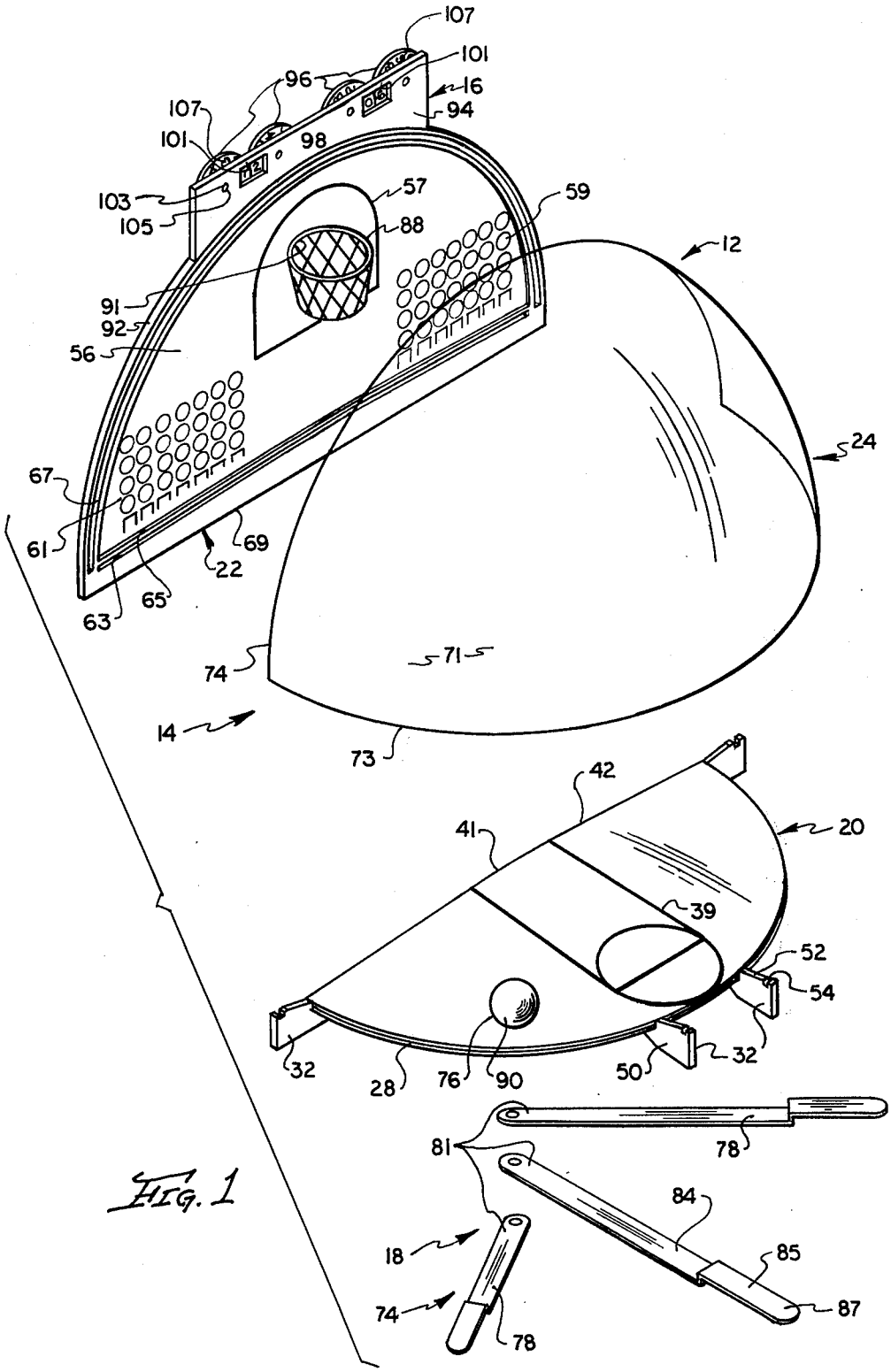
FIG. 1 is an exploded perspective view of the mini-dome basketball game of this invention.

The following is a discussion and description of preferred specific embodiments of the new mini-dome basketball game of this invention, such being made with reference to the drawings, whereupon the same reference numerals are used to indicate the same or similar parts and/or structure. It is to be understood that such discussion and description is not to unduly limit the scope of the invention.

In one preferred embodiment as shown in FIG. 1, a mini-dome basketball game, indicated generally at 12, includes a main enclosure means 14; a score means 16 mounted on the main enclosure means 14; and an actuator means 18 connected to the enclosure means 14. The main enclosure means 14 includes a basic support means 20; a back stop means 22 secured to the basic support means 20 and extended upwardly therefrom; and a dome means 24 connected to the back stop means 22 and the basic support means 20 to define in an enclosed minature basketball court area indicated at 26.

The basic support means 20 includes a support floor assembly 28; a support rail member 30 secured to the support floor assembly 28; and a plurality of spaced support leg members 32 secured to the support floor assembly 28. The support floor assembly 28 includes a first floor member 34 and a second floor member 36, both of which are of semi-circular in shape and joined at the outer curved edge portion 38 thereof. The first floor member 34 being a generally semi-circular shape has a free-throw line indicia 39 mounted theron and inclined outwardly and downwardly from a central portion thereof indicated at 41 to the juncture with the second floor member 36 for reasons to become obvious.

The second floor member 36 is of substantially identical shape of the first floor member 34 except it is extended in a generally horizontal plane and having a straight edge indicated at 42 thereof operable to be connected to the back stop means 22. The support rail 30 is of a generally semi-circular shape and is attached to a mid-portion of the second floor member 36 and having a plurality of support legs 44 to rest against a support surface 46 for operation in a manner to be explained.

The support leg members 32, being four (4) in number, are secured at spaced points along the outer edge 38 of the second floor member 36 and are operable to support the dome means 24 as will be explained. Each support leg member 32 includes a main body 50 having a stepped end section 52 and a upper support groove 54 therein. The stepped end section 52 is adapted to rest on the support surface 46 and attached to the second floor member 36 to provide the proper elevation and support thereto. The support groove 54 is adapted to receive a portion of the dome means 24 as will be explained.

The back stop means 22 includes a semi-circular support member 56 having a backboard indicia 57 and crowd indicia 59 marked thereon. The support member 56 includes an upright main body 61 having a horizontal floor support groove 63 therein to receive the second floor member 36, a parallel groove 65 to receive the first floor member 34 therein; and a semi-circular dome support groove 67 about its outer periphery. The main body 61 has a lower horizontlly extended edge 69 to rest on the support surface. The backboard indicia 57 and crowd indicia 59 resembles spectators observing a basketball game in progress.

The dome means 24 includes a transparent cover member 71 which is substantially equal to a quarter portion of a sphere. A lower edge 73 of the cover member 71 is operable to be mounted within the support grooves 54 of the leg members 32 to aid in vertical stability. A vertically extended curved edge 74 of the cover member 71 is operable to be placed in a snug manner within the semi-circular dome support groove 67 in the support member 56 of the back stop means 22 to provide the necessary support.

The actuator means 18 includes actuator flipper members 74 and game members 76. The actuator flipper members 74 consists of a pair of player flipper members 78 and a free-throw flipper member 79. All of subject flipper members are joined at a common end portion 81 thereof through a support post 83 to a point centrally of the junction between the first floor member 34 and the backstop means 22.

More particularly, the player flipper members 78 each include an elongated main body 84 having a hole at one end to be mounted about the support post 83 for pivotal movement and having a stepped portion 85 at the other end. The stepped portion 85 is provided outwardly therefrom with a finger actuator section 87 operable to actuate the player flipper members 78 as will be explained. The free-throw flipper member 79 is substantially identical to the player flipper members 78 except it is mounted between the player flipper members 78 and is limited to operation between the free-throw indicia 39 in a manner to be explained.

The game members 76 include a basket member 88 secured to the backstop means 22 and a ball member 90 retained within the main enclosure means 14. The basket member 88 is of a conventional nature having a hole 91 therein and having a portion attached to the backstop means 22 in a conventional manner to resemble a basketball goal. The ball member 90 is of such a size to fit through the hole 91 in the basket member 88 and operable to resemble a regulation basketball member in appearance and being freely movable within the confines of the dome means 24.

The score means 16 is attached to an upper edge 92 of the backstop means 22 and provided with a housing assembly 94 and a plurality of disc members 96. The housing assembly 94 includes a main body 98 having a pair of spaced rectangular openings 101 therein. The disc members 96, namely a pair of cooperating members, are mounted on central shaft 103 which, in turn, are rotatably mounted in holes 105 within the housing assembly 94 and each disc member has numerical indicia 107 from 0 through 9, inclusive thereon. Pairs of the disc members 96 cooperate to perform any combination of numbers from 0 – 0 up to 99 to indicate the basketball scores of the respective members or teams playing the mini-dome basketball game 12 of this invention.

Figure 2:
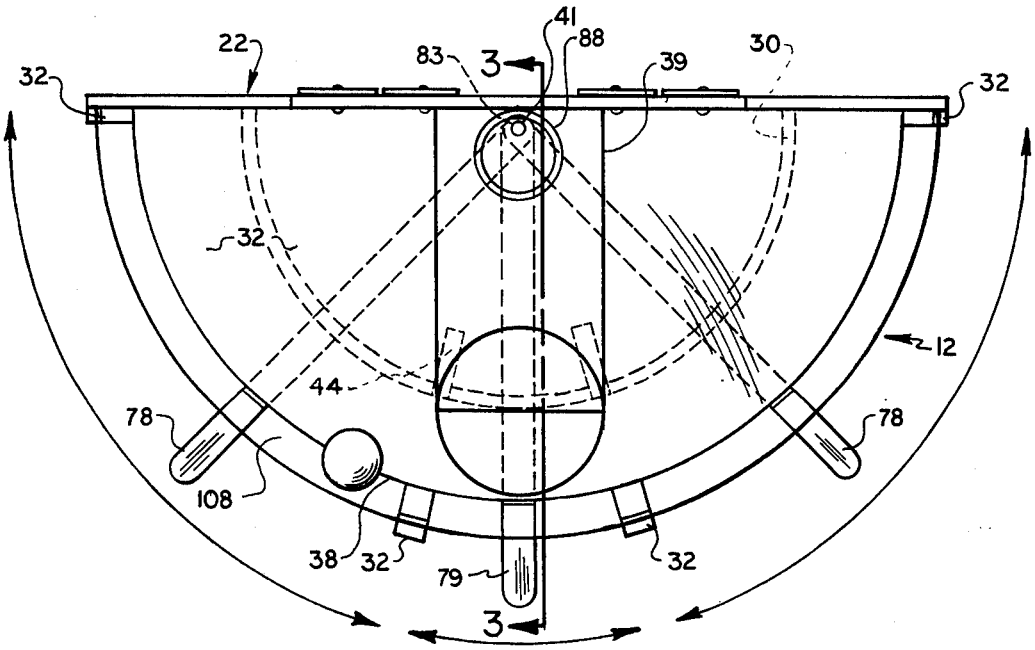
FIG. 2 is a top plan view of the mini-dome basketball game of this invention.
Figure 3:
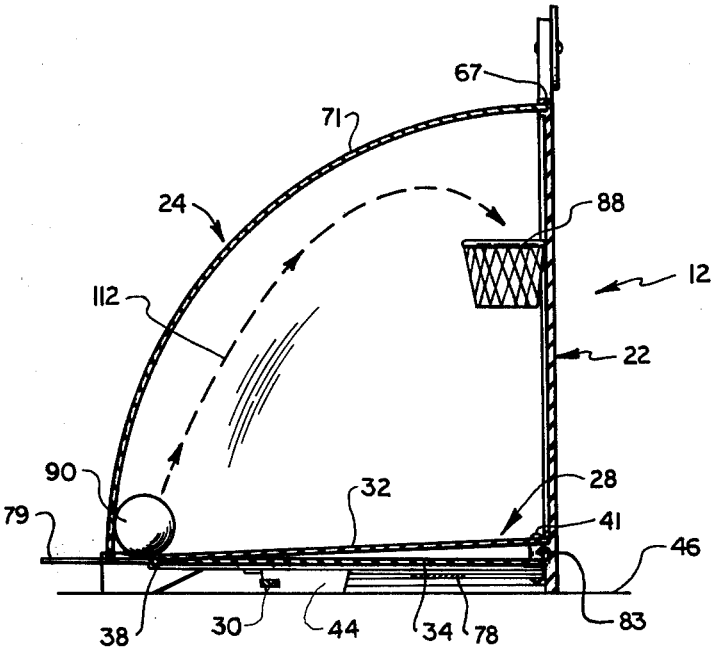
FIG. 3 is a section view taken along line 3—3 in FIG. 2.

In the use and operation of the mini-dome basketball game 12 of this invention and in the assembled condition as shown in FIGS. 2 and 3, it is seen that this provides a very compact, economical structure having the player elements which is the flipper members 78, 79 and the ball member 90 enclosed within the dome means 22 so that there is no possiblity of losing any elements of this game invention. The basket member 88 is mounted on the backstop means 22 in such a relation relative to the ball member 90 so as to present a scaled down miniture basketball game structure. The transparent dome means 24 allows one to clearly observe the playing of the game while retaining the ball member 90 within the desired confines.

Each of the player flipper members 78 are pivotal about the upright support post 83 within an arch less than 90° and being within adjacent pairs of the support leg members 32. The free-throw flipper member 79 is mounted between central one's of the support leg members 32 and its movement is confined between the free-throw line indicia 39 for free-throws. The point of the stepped portion 85 of the respective flipper members 78, 79 is that they are movable through a space indicated at 108 between the transparent cover member 71 and the junction of the first and second members 34 and 36. This allows the actuator flipper members 78, 79 to be moved downwardly and subsequently upwardly to contact the ball member 90 for propelling the same upwardly into the basket member 88 as shown by dotted lines 112 in FIG. 3.

In playing a simulated basketball game with the mini-dome basketball game 12 of this invention, it can be played with a plurality of players on each side but will normally be played with two players, each one representing a basketball team. The players will each take one respective side of the dome means 24 as defined by respective one's of the players flipper members 78 and each player's area would be between the support leg members 32. On a player member placing the ball member 90 through the basket member 88, the player will be awarded two points as in a normal basketball game and such can be indicated on respective one's of the disc members 96 of the score means 16. On the ball falling within the free-throw area which is defined between the central support leg members 32, the respective player entitled to the free-throws should use the free-throw flipper member 79 in an attempt to propell the ball member 90 into the basket member 88. It is noted that this game can be played with a stop watch on a time basis or, in the alternative, can be played until a certain team scores a predetermined amount of points and, is declared the winner.

It is seen that the mini-dome basketball game of this invention can be utilized to duplicate a regular basketball game with the skill required to propell the ball member in the proper direction and proper force so as to achieve a basket on placing the ball member through the basket member. The mini-dome basketball game is a compact game structure which is self contained so as to not lose any playing parts thereof. Additionally, the mini-dome basketball game is economical to manufacture, sturdy in structure, and provides a means of entertainment for persons of substantially all ages.

While the invention has been described in conjunction with preferred specific embodiments thereof, it will be understood that this description is intended to illustrate and not to limit the scope of the invention, which is defined by the following claims.

I claim:

1. A basketball game structure used by two or more persons to simulate the playing of a basketball game, comprising:

a. a main enclosure means to rest on a support surface and having an actuator means associated therewith;

b. said main enclosure means having a basic support means and a backstop means extended perpendicular thereto; and a dome means connected to said backstop and said basic support means to define a game playing area;

c. said actuator means having flipper members connected to said basic support means; a basket member connected to said backstop means; and a ball member mounted within said playing area;

d. said basic support means having a semi-circular shaped first floor member with a diametrical axis elevated above the semi-circular edge of said first floor member whereby said ball member is actuated under the force of gravity to move toward said semi-circular edge;

e. said flipper members include two player flipper members and a free-throw flipper member;

f. said flipper members each having a main body with one end pivotally connected to a support post which is secured at the center of said diametrical axis of said basic support means; and g. an outer end of said flipper members are formed with a stepped portion engagable with said ball member to propell same toward said basket member;

whereby said flipper members are operable to contact said ball member and propell same to said basket member to score points as in a conventional basketball game.

2. A basketball game structure as described in claim 1, wherein:

a. said basic support means having downwardly extended support leg members to contact the support surface; and b. adjacent outer pairs of said support leg members defining a limited lateral movement area for said player flipper members.

3. A basketball game structure as described in claim 2, wherein:

a. a central pair of said support leg members defining a free-throw area and having said free-throw flipper member mounted therebetween;

whereby said free-throw flipper member is used by each team player as required.

4. A basketball game as described in claim 1, wherein:

a. said flipper members are constructed of a resilient material so as to bend on downward depression with said connection to said suport post being rigid whereby the force at which said flipper members contact said ball member varies with the downward depression thereof; and b. said flipper members are movable laterally about said support post to achieve the desired position relative to said ball member before hitting same to propell toward said basket member.

* * * * *